US010240423B2

(12) United States Patent
Nguyen

(10) Patent No.: US 10,240,423 B2
(45) Date of Patent: Mar. 26, 2019

(54) CONNECTOR SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 458 days.

(21) Appl. No.: 14/983,188

(22) Filed: Dec. 29, 2015

(65) Prior Publication Data

US 2017/0183933 A1 Jun. 29, 2017

(51) Int. Cl.

| | |
|---|---|
| ***E21B 33/03*** | (2006.01) |
| ***E21B 33/04*** | (2006.01) |
| ***E21B 33/038*** | (2006.01) |
| ***E21B 17/02*** | (2006.01) |

(52) U.S. Cl.

CPC ..... *E21B 33/03* (2013.01); *E21B 17/02* (2013.01); *E21B 33/038* (2013.01); *E21B 33/04* (2013.01)

(58) Field of Classification Search

CPC ..... E21B 33/03; E21B 33/038; E21B 33/04
See application file for complete search history.

(56) References Cited

U.S. PATENT DOCUMENTS 4,516,795 A * 5/1985 Baugh ..... E21B 33/038 285/315
5,325,925 A * 7/1994 Smith ..... E21B 33/04 166/196
2003/0145996 A1* 8/2003 singeetham ..... E21B 33/038 166/345
2005/0284640 A1 12/2005 Borak
2007/0267197 A1* 11/2007 Pallini ..... E21B 17/085 166/367
2008/0006412 A1 1/2008 Ford
2010/0116486 A1* 5/2010 Minassian ..... E21B 33/04 166/88.1
2010/0147533 A1* 6/2010 Nelson ..... E21B 33/04 166/379
2015/0129243 A1 5/2015 Nguyen

OTHER PUBLICATIONS

PCT International Search Report & Written Opinion for PCT Application No. PCT/US2016/067871 dated Jul. 6, 2017; 13 Pages.

* cited by examiner

*Primary Examiner* — Benjamin F Fiorello
(74) *Attorney, Agent, or Firm* — Fletcher Yoder, P.C.

(57) ABSTRACT

A system including a connector system configured to couple a first tubular to a second tubular comprising a sleeve configured to couple to the first tubular, wherein an inner diameter of the sleeve comprises a coupling feature, a lock ring configured to couple to an exterior surface of the second tubular and radially engage with the coupling feature of the sleeve, a piston ring configured to energize the lock ring into engagement with the sleeve, a first pressure ring configured to couple to the second tubular, wherein the first pressure ring is axially beneath the piston ring, and a second pressure ring disposed about the piston ring and configured to couple to the second tubular.

20 Claims, 6 Drawing Sheets

CONNECTOR SYSTEM

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. For instance, a wellhead system often includes a tubing hanger and/or casing hanger that is disposed within the casing or tubing spool or housing, where the tubing hanger or casing hanger is configured to secure tubing and casing suspended in the well bore. The hanger generally provides a path for hydraulic control fluid, chemical injections, or the like to be passed through the wellhead and into the well bore. Additionally, the tubing hanger provides a path for production fluid to be passed through the wellhead and exit the wellhead through a production flow bore to an external production flow line. In certain circumstances, multiple tubing or casing spools or housings may be used in the wellhead system. For example, multiple tubing or casing spools or housings may be stacked on top of one another or may be positioned side by side in a "shared" wellhead arrangement. The connections between these components benefit from strength and stability, to support high loads and stress in harsh operating environments.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
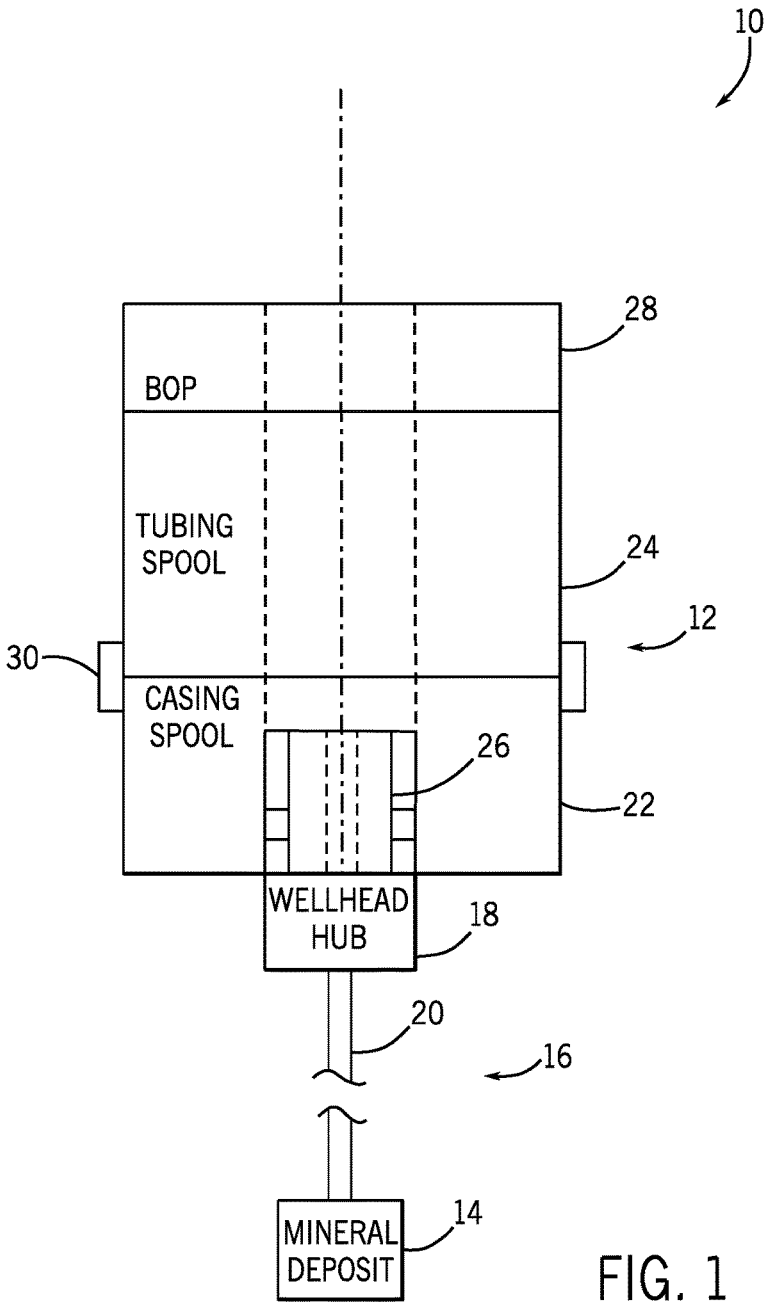
FIG. 1 is a block diagram of an embodiment of a mineral extraction system with a connector system, in accordance with aspects of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a connector system for coupling mineral extraction system components to one another. For example, the connector system may form a strong and stable connection between a tubing spool and a casing spool, multiple self-similar spools, or other wellhead components. As will be described in detail below, the disclosed connector system includes a sleeve coupled to or integrated with a first tubular, where the sleeve engages a lock ring of a second tubular. For example, the sleeve may include a coupling feature (e.g., a surface geometry) that enables the lock ring to couple to the sleeve, thereby blocking axial movement of the sleeve, and thus the first tubular coupled to the sleeve. The lock ring is energized by a piston ring that drives the lock ring radially outward and into engagement with the sleeve, while simultaneously blocking retraction of the lock ring. For example, the piston ring may move radially inside the lock ring, which blocks the lock ring from moving radially inward. As discussed in detail below, the piston ring is hydraulically actuated to drive the piston ring into an energized position that forces the lock ring radially outward to engage with the sleeve and thereby place the connector system in a locked state or position. The piston ring may be similarly hydraulically actuated to drive the piston ring into a de-energized or unlocked position. That is, the piston ring may be hydraulically actuated to disengage the piston ring from the lock ring, thereby enabling the lock ring to radially contract and disengage with the sleeve of the connector system, which places the connector system in an unlocked state or position. The disclosed embodiments may be enable easier and faster coupling and decoupling of wellhead components compared to traditional coupling systems that may primarily utilize threaded connections and/or bolted connections between wellhead components. The disclosed connector systems may also be smaller, slimmer, and/or manufactured from fewer amounts of materials, thereby enabling reduction in manufacturing costs.

FIG. 1 is a block diagram that illustrates a mineral extraction system 10 that can extract various minerals and natural resources, including hydrocarbons (e.g., oil and/or natural gas), from the earth. The mineral extraction system 10 may be land-based (e.g., a surface system) or subsea (e.g., a subsea system). The system 10 includes a wellhead 12 coupled to a mineral deposit 14 via a well 16, wherein the well 16 includes a wellhead hub 18 and a wellbore 20. The wellhead hub 18 includes a large diameter hub at the end of the wellbore 20 that enables the wellhead 12 to couple to the well 16. The wellhead 12 typically includes multiple components that control and regulate activities and conditions associated with the well 16. For example, the wellhead 12 includes a casing spool 22 (e.g., tubular), a tubing spool 24 (e.g., tubular), a hanger 26 (e.g., a tubing hanger or a casing hanger), a blowout preventer (BOP) 28, and a "Christmas" tree to control the flow of fluids into and out of the well. As will be explained in detail below, the hydrocarbon extraction system 10 also includes a connector system 30 that facilitates coupling of various components within the mineral extraction system 10. For example, in the illustrated embodiment, the connector system 30 enables coupling of the casing spool 22 to the tubing spool 24. In other embodiments, the connector system 30 may couple two self-similar spools (e.g., two casing spools 22, two tubing spools 24, etc.). Other embodiments may include connector systems 30 that couple wellhead components (e.g., spools) of conductor sharing wellheads.

Figure 2:
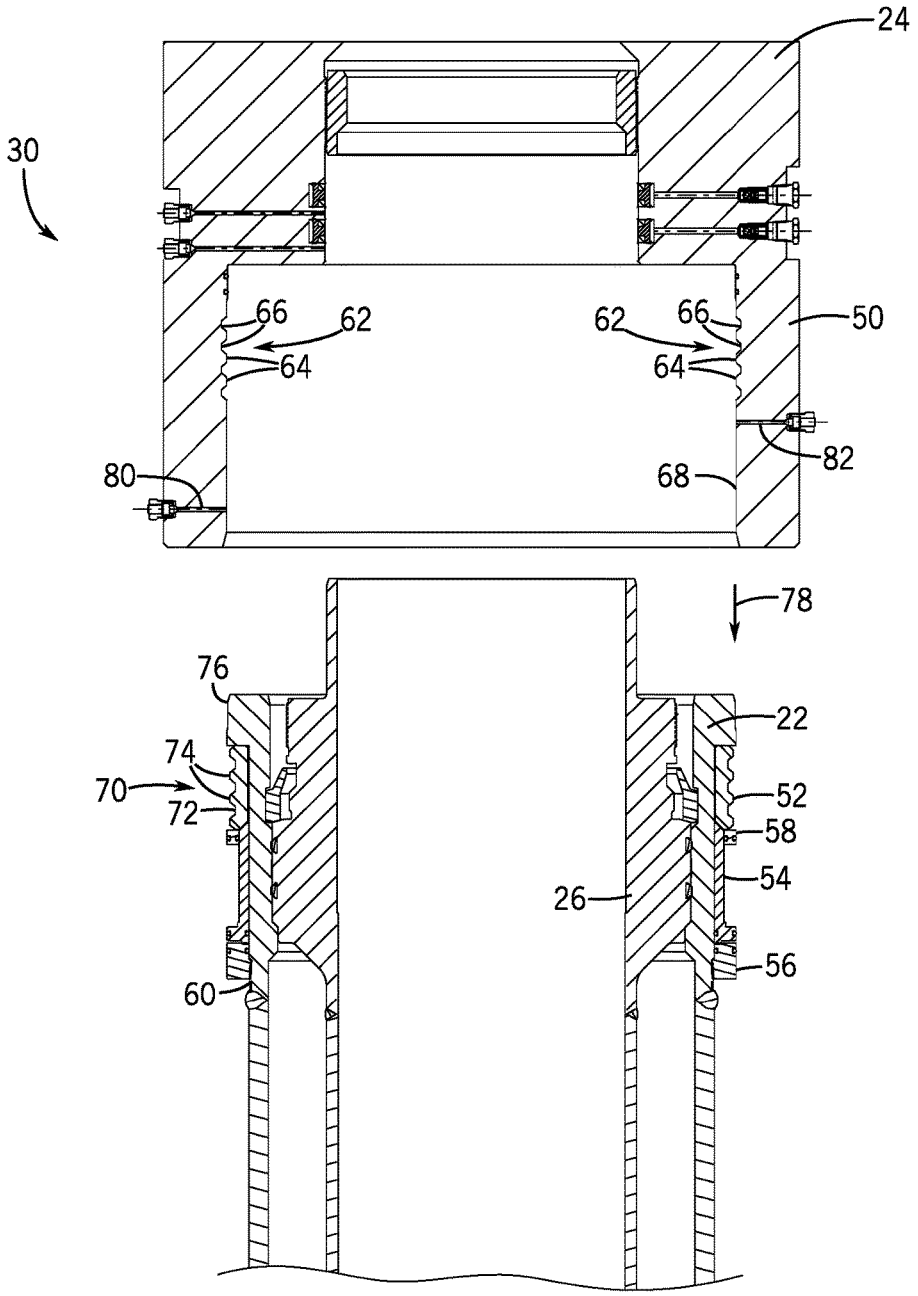
FIG. 2 is a cross-sectional side view of an embodiment of a connector system with a first tubular axially separated from a second tubular, in accordance with aspects of the present disclosure.

FIG. 2 is a cross-sectional side view of an embodiment of the connector system 30. The connector system 30 includes a sleeve 50, a lock ring 52 (e.g., c-ring), and a piston ring 54 (e.g., annular piston ring). In the illustrated embodiment, the sleeve 50 is integrally formed with the tubing spool 24 (e.g., a first tubular). In other words, the sleeve 50 and the tubing spool 24 form a single piece. However, in other embodiments, the sleeve 50 may be a separate component that is removably attached to the tubing spool 24. For example, the sleeve 50 may include threads on an inner surface (e.g., inner annular surface or circumference) that engage with threads on an outer surface (e.g., outer annular surface or circumference) of the tubing spool 24. In further embodiments, the sleeve 50 may be part of or coupled to the casing spool 22.

The lock ring 52 and the piston ring 54 are disposed about the casing spool 22 (e.g., second tubular). The connector system 30 also includes a first pressure ring 56 disposed about the casing spool 22 and a second pressure ring 58 disposed about the casing spool 22. As described in detail below, the first and second pressure rings 56 and 58 cooperate with the piston ring 54 and other components to form hydraulic pressure chambers that enable the hydraulic actuation of the piston ring 54 to energize and de-energize the connector system 30. In other words, the first and second pressure rings 56 and 58 cooperate with the piston ring 54 and other components to enable hydraulic coupling and de-coupling of the casing spool 22 and tubing spool 24 to and from one another. In the illustrated embodiment, the first pressure ring 56 is threaded to the casing spool 22 via a threaded connection 60. However, in other embodiments, the first pressure ring 56 may be coupled to the casing spool 20 in other manners, such as via mechanical fasteners. The second pressure ring 58 may be coupled to the casing spool 22 via a pinned connection. For example, one or more pins may extend from the second pressure ring 58 through one or more slots (e.g., axial slots) formed in the piston ring 56 and may couple to the casing spool 22. However, the second pressure ring 58 may alternatively be coupled to the casing spool 22 in other suitable manners.

The sleeve 50 includes a sleeve coupling feature 62 (e.g., a surface geometry, an annular groove, annular grooves and protrusions, etc.) that enables the lock ring 52 to couple to the sleeve 50. For example, the coupling feature 62 may include a series of annular protrusions 64 and annular recesses 66 (e.g., threads) formed in an inner diameter 68 of the sleeve 50. The annular protrusions 64 and annular recesses 66 engage a corresponding lock ring coupling feature 70 (e.g., surface geometry), which includes annular recesses 72 and annular protrusions 74 (e.g., threads or teeth). In some embodiments, the coupling feature 62 may be one or more grooves that receives the lock ring 52.

As illustrated, the lock ring 52, the piston ring 54, the first pressure ring 58, and the second pressure ring 58 sit axially beneath a flange or shoulder 76 of the casing spool 22. The shoulder 76 enables the sleeve 50 to slide axially over the casing spool 22 in direction 78 to land the tubing spool 24 against the casing spool 22. The shoulder 76 also enables an energizing pressure port 80 and a de-energizing pressure port 82 of the sleeve 50 to properly align with other components of the connector system 30 when the tubing spool 24 is landed against the casing spool 22. Moreover, when shoulder 76 enables alignment of the coupling feature 62 of the sleeve 50 with the coupling feature 70 of the lock ring 52 when the tubing spool 24 is landed against the casing spool 22.

Figure 3:
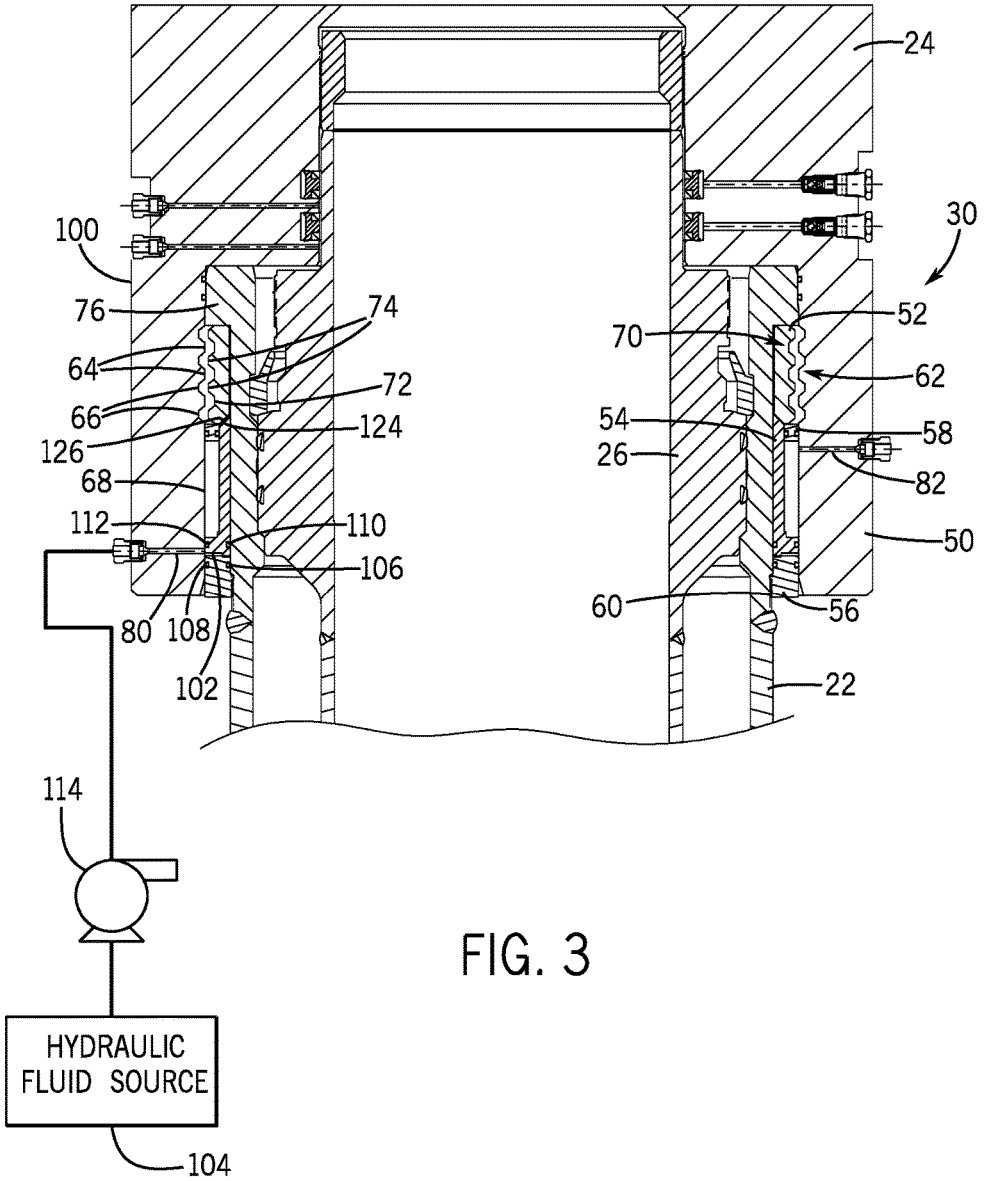
FIG. 3 is a cross-sectional side view of an embodiment of an connector system with a first tubular landed on a second tubular and the connector system in a de-energized position, in accordance with aspects of the present disclosure.

FIG. 3 is a cross-sectional side view of an embodiment of the connector system 30 with the tubing spool 24 landed on the casing spool 22. In this landed position, several components and features of the connector system 30 align with one another to enable energization (e.g., hydraulic energization) and de-energization of the connector system 30 to couple the tubing spool 24 to the casing spool 22. For example, as mentioned above, when the tubing spool 24 is landed against the casing spool 22, the coupling feature 62 of the sleeve 50 is radially aligned with the coupling feature 70 of the lock ring 52. In particular, the annular protrusions 74 of the lock ring 52 radially align with the annular recesses 66 of the sleeve 50, and the annular recesses 72 of the lock ring 52 radially align with the annular protrusions 64 of the sleeve 50.

When the tubing spool 24 is landed against the casing spool 22, other structural features of the connector system 30 align with one another to enable hydraulic actuation of the connector system 30, which enables coupling of the tubing spool 24 to the casing spool 22. For example, in the landed configuration shown in FIG. 3, the energizing pressure port 80, which extends from an outer diameter 100 of the sleeve 50 to the inner diameter 68 of the sleeve 50, is radially aligned with an energization chamber 102 (e.g., annular chamber) of the connector system 30. The energization chamber 102 is generally defined by the piston ring 54, the first pressure ring 56, the casing spool 22, and the sleeve 50. The energization chamber 102 is configured to receive a hydraulic fluid (e.g., from a hydraulic fluid source 104) to energize the connector system 30 and couple the tubing spool 24 to the casing spool 22.

To enable containment of the hydraulic fluid within the energization chamber 102, the first pressure ring 56 includes a first seal 106 (e.g., annular seal) and a second seal 108 (e.g., annular seal). Similarly, the piston ring 54 includes a third seal 110 (e.g., annular seal) and a fourth seal 112 (e.g., annular seal). As will be appreciated, the first seal 106 creates a sealing interface between the first pressure ring 56 and the casing spool 22, and the second seal 108 creates a sealing interface between the first pressure ring 56 and the sleeve 50 when the tubing spool 24 having or coupled to the sleeve 50 is landed against the casing spool 22. Similarly, the third seal 110 creates a sealing interface between the piston ring 54 and the casing spool 22, and the fourth seal 112 creates a sealing interface between the piston ring 54 and the sleeve 50 when the tubing spool 24 having or coupled to the sleeve 50 is landed against the casing spool 22. The seals 106, 108, 110, and 112 cooperatively contain pressure within the energization chamber 102 caused by hydraulic fluid being pumped into the energization chamber 102.

Figure 4:
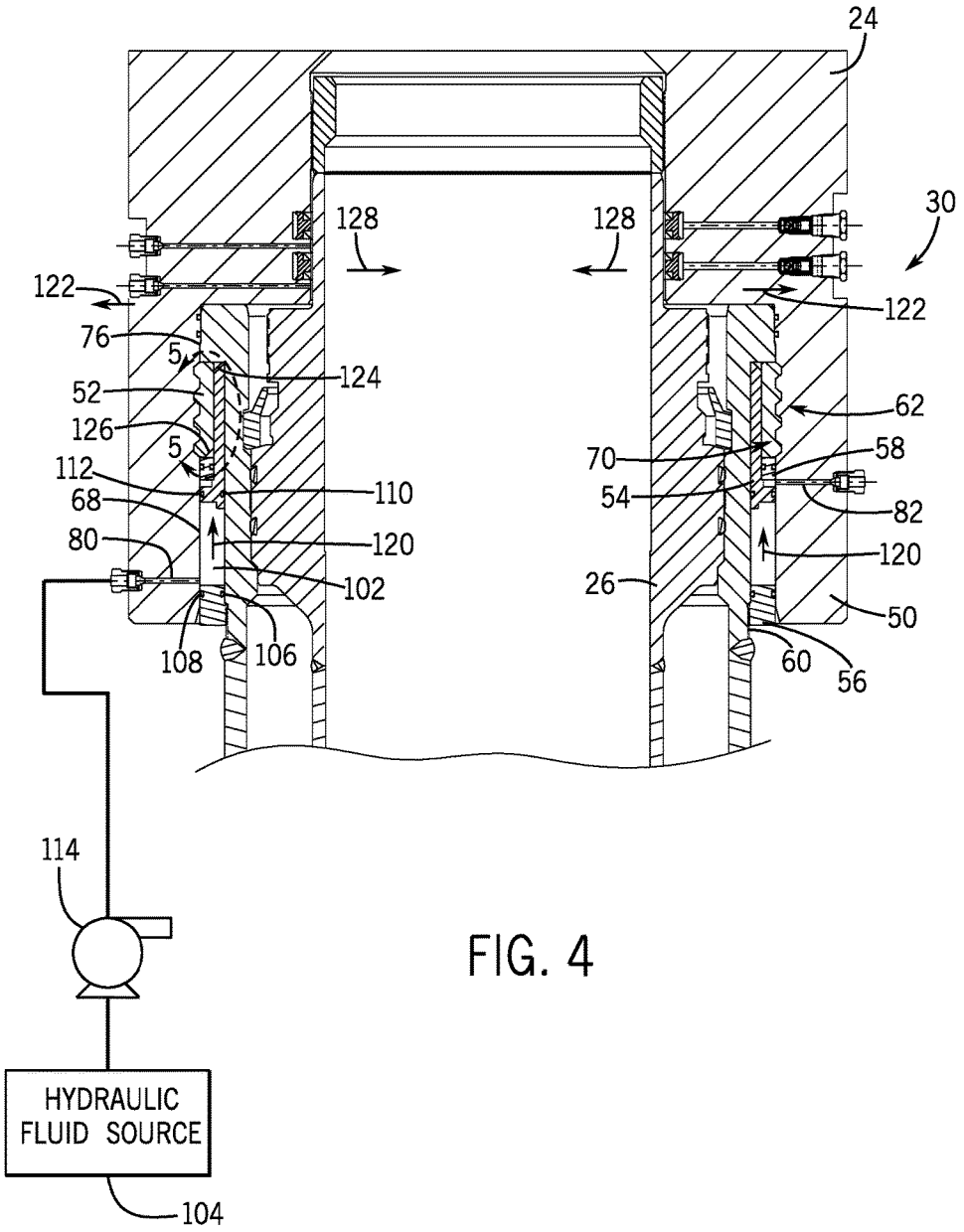
FIG. 4 is a cross-sectional side view of an embodiment of the connector system of FIG. 3 in an energized position, in accordance with aspects of the present disclosure.

To energize the connector system 30 and couple the tubing spool 24 to the casing spool 22, hydraulic fluid (e.g., liquid and/or gas) from the hydraulic fluid source 104 is pumped, e.g., with pump 114, through the energizing pressure port 80 into the energization chamber 102. As hydraulic fluid pressure builds in the energization chamber 102, the piston ring 54 is driven axially upward, as indicated by arrows 120 and as shown in FIG. 4. As the piston ring 54 is driven axially upward, the piston ring 54 is wedged between the lock ring 52 and the casing spool 22, thereby driving the lock ring 52 radially outward, as indicated by arrows 122. To enable wedging of the piston ring 54 between the lock ring 52 and the casing spool 22, the piston ring 54 includes an angled surface 124 that engages with an angled surface 126 of the lock ring 52. Thus, as the piston ring 54 moves in axial direction 120, the angled surface 124 slides past the angled surface 126, driving the lock ring 52 radially outward in directions 122. In other words, the piston ring 54 moves from a position axially offset from the lock ring 52 to an axially overlapping position in which the rings 52 and 54 are partially or entirely overlapping in the axial direction (e.g., partially or entirely concentric).

With the piston ring 54 in an axially overlapping position with the lock ring 52 and with the lock ring 52 driven radially outward, the coupling feature 62 of the sleeve 50 is engaged with the coupling feature 70 of the lock ring 52. More specifically, the annular protrusions 74 of the lock ring 52 engage with the annular recesses 66 of the sleeve 50, and the annular recesses 72 of the lock ring 52 engage with the annular protrusions 64 of the sleeve 50. In this way, the connector system 30 is in an energized or locked position or state. In the energized state, the piston ring 54 blocks radial state of the lock ring 52 in radially-inward direction 128. That is, in this energized position, the casing spool 22 and tubing spool 24 are coupled together with the connector system 30, because the engaged coupling features 62 and 70 of the sleeve 50 and lock ring 52, respectively, block relative axial movement between the casing spool 22 and tubing spool 24. In certain embodiments, the energized state or position of the connector system 30 may be maintained without maintaining a hydraulic or fluid pressure within the energization chamber 102.

Figure 5:
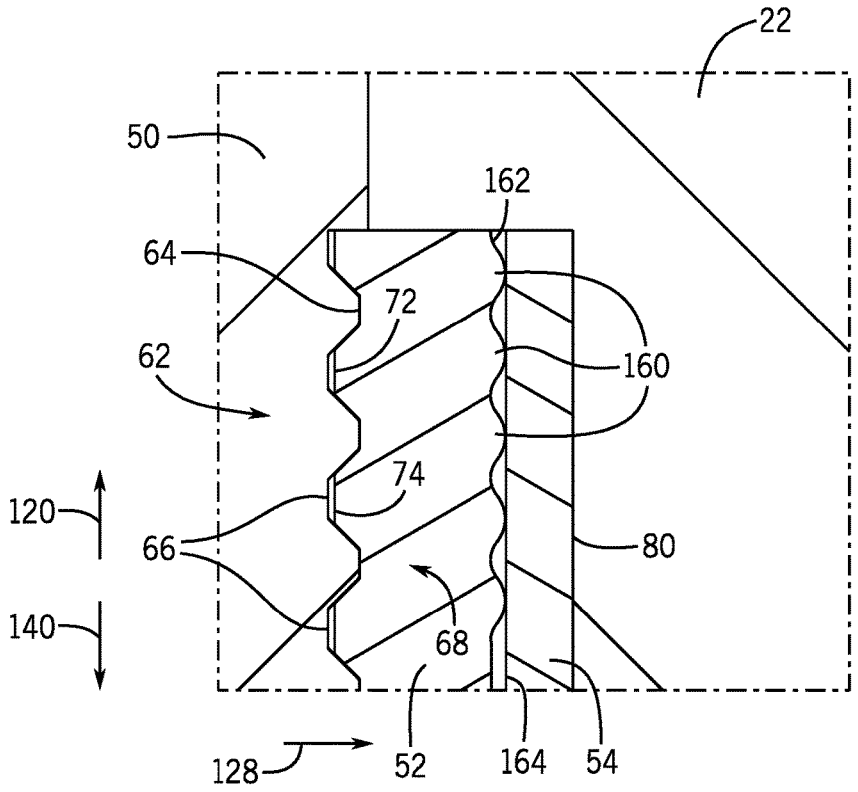
FIG. 5 is a detail view within line 5-5 of FIG. 4, illustrating an embodiment of the connector system in the energized position.

FIG. 5 is a partial cross-sectional view of the connector system 30, taken within line 5-5 of FIG. 4, illustrating the connector system 30 in a locked or energized position. As illustrated, the lock ring 52 is forced radially outward into contact with the coupling feature 62 of the sleeve 50. In some embodiments, the lock ring 52 may include protrusions 160 (e.g., axially spaced annular protrusions or teeth) on an inner surface 162 (e.g., inner annular surface or circumference) of the lock ring 52. The protrusions 160 may create additional force or friction between the surface 162 of the lock ring 52 and a surface 164 (e.g., outer annular surface or circumference) on the piston ring 54. In particular, the protrusions 160 may create friction that that resists or blocks movement of the lock ring 52 in direction 128 and movement of the piston ring 54 in direction 140. While the illustrated protrusions 160 are generally rounded and self-similar, other embodiments may include protrusions 160 with sharp edges, varying sizes, etc.

Figure 6:
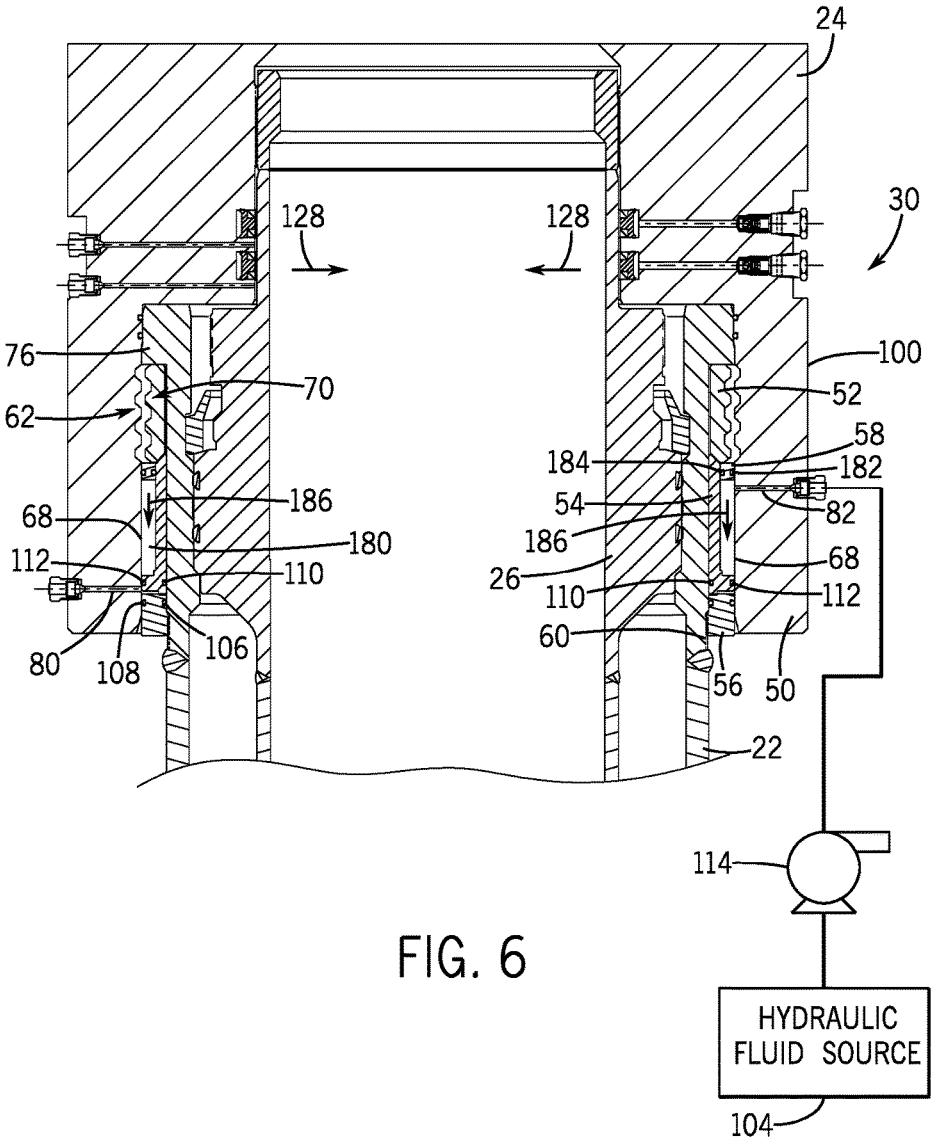
FIG. 6 is a cross-sectional side view of an embodiment of the connector system of FIG. 3 in the de-energized position, in accordance with aspects of the present disclosure.

FIG. 6 is a cross-sectional side view of the connector system 30, illustrating de-energization of the connector system 30 to enable de-coupling of the tubing spool 24 from the casing spool 22. To de-energize the connector system 30 and de-couple the tubing spool 24 from the casing spool 22, hydraulic fluid (e.g., liquid and/or gas) from the hydraulic fluid source 104 is pumped, e.g., with pump 114, through the de-energizing pressure port 82, which extends through the sleeve 50 from the outer diameter 100 of the sleeve 50 to the inner diameter 68 of the sleeve 50. Hydraulic fluid pumped through the de-energizing pressure port 82 enters into a de-energization chamber 180 (e.g., annular chamber) of the connector system 20. The de-energization chamber 180 is generally defined by the piston ring 54, the second pressure ring 58, and the sleeve 50. The de-energization chamber 180 is configured to receive a hydraulic fluid (e.g., from the hydraulic fluid source 104) to de-energize the connector system 30 and de-couple the tubing spool 24 from the casing spool 22. To enable containment of the hydraulic fluid within the de-energization chamber 102, the second pressure ring 58 includes a fifth seal 182 (e.g., annular seal) and a sixth seal 184 (e.g., annular seal). As discussed above, the piston ring 54 also includes the fourth seal 112. As will be appreciated, the fifth seal 182 creates a sealing interface between the second pressure ring 58 and the sleeve 50, and the sixth seal 184 creates a sealing interface between the second pressure ring 58 and piston ring 54. As discussed above, the fourth seal 112 creates a sealing interface between the piston ring 54 and the sleeve 50 when the tubing spool 24 having or coupled to the sleeve 50 is landed against the casing spool 22. The seals 112, 182, and 184 cooperatively contain pressure within the de-energization chamber 180 caused by hydraulic fluid being pumped into the de-energization chamber 180.

As hydraulic fluid pressure builds in the de-energization chamber 180, the piston ring 54 is driven axially downward, as indicated by arrows 186. As the piston ring 54 is driven axially downward, the piston ring 54 is "un-wedged" or removed from between the lock ring 52 and the casing spool 22. In other words, as the piston ring 54 moves in axial direction 186, the piston ring 54 moves from a position axially overlapping the lock ring 52 to a position axially offset from the lock ring 52. As a result, the lock ring 52 may contract (e.g., automatically contract) radially inward in direction 128. As the lock ring 52 radially contracts, the coupling features 62 and 70 of the sleeve 50 and lock ring 52, respectively, disengage from one another and allow relative axial movement between the casing spool 22 and tubing spool 24. In other words, when the connector system 30 is de-energized, the tubing spool 24 and the casing spool 22 may be de-coupled from one another.

As described in detail above, the disclosed embodiments include the connector system 30 for coupling mineral extraction system components to one another. For example, the connector system 30 may form a strong and stable connection between the tubing spool 24 and the casing spool 22, multiple self-similar spools (e.g., casing spools 22 or tubing spool 24), or other wellhead components. While the disclosure above is described in the context of connecting the tubing spool 24 to the casing spool 22, the disclosed connector system 30 may be used to couple other tubulars or components of the system 10.

The connector system 30 includes the sleeve 50 coupled to or integrated with a first tubular (e.g., the tubing spool 24) that engages the lock ring 52 of a second tubular (e.g., the casing spool 22). For example, the sleeve 50 may include the coupling feature 62 (e.g., a surface geometry) that enables the lock ring 52 to couple to the sleeve 50, thereby blocking axial movement of the sleeve 50. The lock ring 52 is energized by the piston ring 54 that drives the lock ring 52 radially outward and into engagement with the sleeve 50, while simultaneously blocking retraction of the lock ring 52. For example, the piston ring 54 may move radially inside the lock ring 52, which blocks the lock ring 52 from moving radially inward. As discussed above, the piston ring 54 is hydraulically actuated to drive the piston ring 54 into an energized position that forces the lock ring 52 radially outward to engage with the sleeve 50 and thereby place the connector system 30 in a locked state or position. The piston ring 54 is similarly hydraulically actuated to drive the piston ring 54 into a de-energized or unlocked position. That is, the piston ring 54 may be hydraulically actuated to disengage the piston ring 54 from the lock ring 52, thereby enabling the lock ring 52 to radially contract and disengage with the sleeve 50 of the connector system 30, which places the connector system 30 in an unlocked state or position. The disclosed embodiments may be enable easier and faster coupling and decoupling of wellhead components compared to traditional coupling systems that may primarily utilized threaded connections and/or bolted connections between wellhead components. The disclosed connector systems 30 may also be smaller, slimmer, and/or manufactured from fewer amounts of materials, thereby enabling reduction in manufacturing costs.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a connector system configured to couple a first tubular to a second tubular, comprising:

a sleeve configured to couple to the first tubular, wherein an inner diameter of the sleeve comprises a coupling feature;

a lock ring configured to couple to an exterior surface of the second tubular and radially engage with the coupling feature of the sleeve;

a piston ring configured to energize the lock ring into engagement with the sleeve;

a first pressure ring configured to couple to the second tubular, wherein the first pressure ring is axially beneath the piston ring; and a second pressure ring disposed about the piston ring and configured to couple to the second tubular, wherein the second pressure ring is configured to move along the piston ring.

2. The system of claim 1, wherein the coupling feature comprises one or more grooves, and the lock ring comprises one or more protrusions configured to engage the one or more grooves.

3. The system of claim 1, wherein the second pressure ring comprises an inner seal and an outer seal, and the inner seal is disposed between the second pressure ring and the piston ring.

4. The system of claim 1, comprising the second tubular, wherein the first pressure ring, the piston ring, the sleeve, and the second tubular are configured to cooperatively define a fluid energization chamber of the connector system.

5. The system of claim 4, wherein the sleeve comprises an energization pressure port extending from an outer diameter of the sleeve to an inner diameter of the sleeve, wherein the energization pressure port is fluidly connected to the fluid energization chamber.

6. The system of claim 1, wherein the second pressure ring, the piston ring, and the sleeve are configured to cooperatively define a fluid de-energization chamber of the connector system.

7. The system of claim 6, wherein the sleeve comprises a de-energization pressure port extending from an outer diameter of the sleeve to an inner diameter of the sleeve, wherein the de-energization pressure port is fluidly connected to the fluid de-energization chamber.

8. The system of claim 1, wherein the piston ring comprises an inner seal and an outer seal.

9. The system of claim 1, wherein the piston ring comprises a first angled surface, the lock ring comprises a second angled surface, and the first and second angled surfaces are configured to engage with one another during energization of the connector system.

10. The system of claim 1, wherein the lock ring comprises a plurality of annular protrusions formed on an inner diameter of the lock ring, and the plurality of annular protrusions is configured to engage with the piston ring when the connector system is in an energized state.

11. A system, comprising:

a mineral extraction system, comprising:

a first tubular;

a second tubular; and a connector system configured to couple the first tubular to the second tubular, comprising:

a sleeve coupled to the first tubular, wherein the sleeve comprises:

a coupling feature formed on an inner diameter of the sleeve;

a first pressure port extending from an outer diameter of the sleeve to the inner diameter of the sleeve, wherein the first pressure port is configured to fluidly connect with a first pressure chamber of the connector system; and a second pressure port extending from the outer diameter of the sleeve to the inner diameter of the sleeve, wherein the second pressure port is configured to fluidly connect with a second pressure chamber of the connector system;

a lock ring coupled to the second tubular and configured to radially engage with the coupling feature of the sleeve; and a piston ring configured to energize the lock ring into engagement with the sleeve.

12. The system of claim 11, wherein the coupling feature comprises one or more grooves configured to receive the lock ring.

13. The system of claim 11, wherein the connector system comprises a first pressure ring coupled to the second tubular, and wherein the first pressure ring, the piston ring, the sleeve, and the second tubular cooperatively define the first pressure chamber.

14. The system of claim 13, wherein the connector system comprises a second pressure ring coupled to the second tubular, and wherein the second pressure ring, the piston ring, and the sleeve cooperatively define the second pressure chamber.

15. The system of claim 14, wherein the connector system comprises a first seal configured to create a first sealing interface between the first pressure ring and the second tubular, a second seal configured to create a second sealing interface between the first pressure ring and the sleeve, a third seal configured to create a third sealing interface between the piston ring and the second tubular, and a fourth seal configured to create a fourth sealing interface between the piston ring and the sleeve, wherein the first, second, third, and fourth seals are configured to seal the first pressure chamber.

16. The system of claim 15, wherein the connector system comprises a fifth seal configured to create a fifth sealing interface between the second pressure ring and the sleeve, and a sixth seal configured to create a sixth sealing interface between the second pressure ring and the second tubular, wherein the fourth, fifth, and sixth seals are configured to seal the second pressure chamber.

17. A method, comprising:

landing a first tubular against a second tubular;

pumping hydraulic fluid through a first pressure port of a sleeve coupled to the first tubular and into a first pressure chamber fluidly coupled to the first pressure port to drive a piston ring between a lock ring and the second tubular, wherein a first outer seal is disposed between the piston ring and the sleeve and a first inner seal is disposed inside of an inner diameter of the piston ring; and driving the lock ring radially outward with the piston ring to engage a first coupling feature of the lock ring with a second coupling feature of the sleeve to couple the first tubular to the second tubular and block relative axial movement between the first tubular and the second tubular.

18. The method of claim 17, comprising containing pressure of the hydraulic fluid within the first pressure chamber axially between the piston ring and a first pressure ring having a second outer seal and a second inner seal.

19. The method of claim 17, comprising pumping hydraulic fluid through a second pressure port of the sleeve coupled to the first tubular and into a second pressure chamber to drive the piston ring out from between the lock ring and the second tubular to disengage the lock ring from the sleeve and to de-couple the first tubular from the second tubular.

20. The method of claim 17, comprising moving a second pressure ring along the piston ring.

* * * * *